United States Patent [19]

Blecher

[11] Patent Number: 4,640,073

[45] Date of Patent: Feb. 3, 1987

[54] FLOOR PLATE

[75] Inventor: Peter Blecher, Hagen, Fed. Rep. of Germany

[73] Assignee: Ermossa AG, Chur, Switzerland

[21] Appl. No.: 825,792

[22] Filed: Feb. 3, 1986

[30] Foreign Application Priority Data

Feb. 2, 1985 [EP] European Pat. Off. ..... 85101111.4
Dec. 17, 1985 [EP] European Pat. Off. ..... 85116090.3

[51] Int. Cl.[4] ..... E04F 15/024

[52] U.S. Cl. ..... 52/403; 52/126.6; 52/263; 52/393; 52/396; 52/598; 52/828

[58] Field of Search ..... 52/126.6, 263, 597, 52/598, 599, 393, 396, 403, 828

[56] References Cited

U.S. PATENT DOCUMENTS

| | | | |
|---|---|---|---|
| 1,986,465 | 1/1935 | Dempsey | 52/403 |
| 2,086,525 | 7/1937 | Akers | 52/599 |
| 2,097,781 | 11/1937 | Venzie | 52/599 X |
| 2,197,150 | 4/1940 | Lambert | 52/828 X |
| 2,956,653 | 10/1960 | Liskey, Jr. | 52/126.6 X |
| 3,740,916 | 6/1973 | Kenaga | 52/828 |
| 3,838,245 | 9/1974 | Jecmen et al. | 52/828 X |
| 3,976,269 | 8/1976 | Gupta | 52/828 X |
| 4,035,967 | 7/1977 | Harvey | 52/126.6 |
| 4,067,156 | 1/1978 | Downing . | |
| 4,279,109 | 7/1981 | Madl, Jr. | 52/263 |
| 4,447,998 | 5/1984 | Griffin | 52/126.6 |

FOREIGN PATENT DOCUMENTS

| | | | |
|---|---|---|---|
| 854940 | 11/1970 | Canada | 52/263 |
| 747939 | 10/1944 | Fed. Rep. of Germany | 52/599 |
| 2054619 | 8/1971 | Fed. Rep. of Germany | 52/126.6 |
| 2700619 | 7/1977 | Fed. Rep. of Germany . | |
| 7804148 | 7/1978 | Fed. Rep. of Germany . | |
| 8107208 | 3/1981 | Fed. Rep. of Germany . | |
| 2382559 | 11/1978 | France | 52/828 |
| 508992 | 7/1939 | United Kingdom | 52/828 |

OTHER PUBLICATIONS

Sheet Metal Worker, Sep. 1943, p. 74.

*Primary Examiner*—Alfred C. Perham
*Attorney, Agent, or Firm*—Spencer & Frank

[57] ABSTRACT

A floor plate which is adapted to accommodate a filler material includes a base plate and a frame; a plurality of ribs extending parallel to one another and projecting from the plane of the base plate. The frame extends integrally from the base plate along a perimeter thereof and in the same direction as the ribs. A plurality of reinforcing rails extends parallel to one another and perpendicularly to the ribs; each rail is fastened to several ribs. A channel is formed along a free circumferential edge of the frame; the channel is open in a direction toward the plane of the base plate.

17 Claims, 19 Drawing Figures

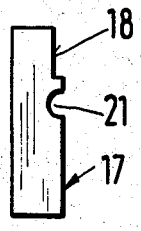
Fig.10d)
Fig.10b)
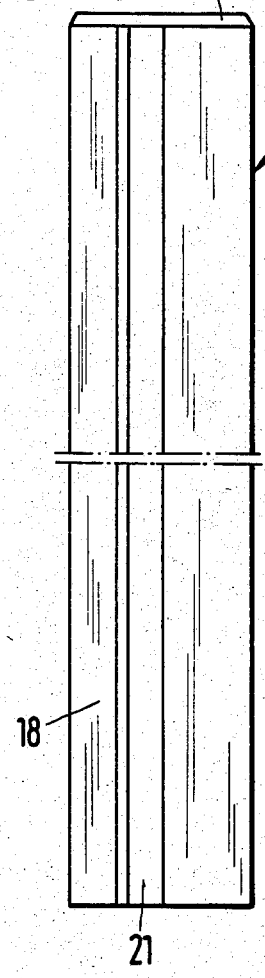
Fig.10a)
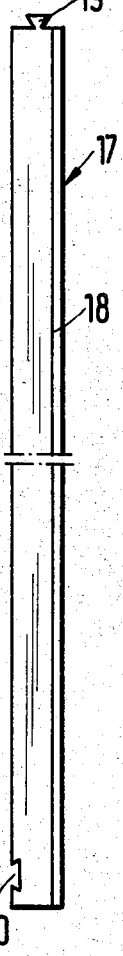
Fig.10c)
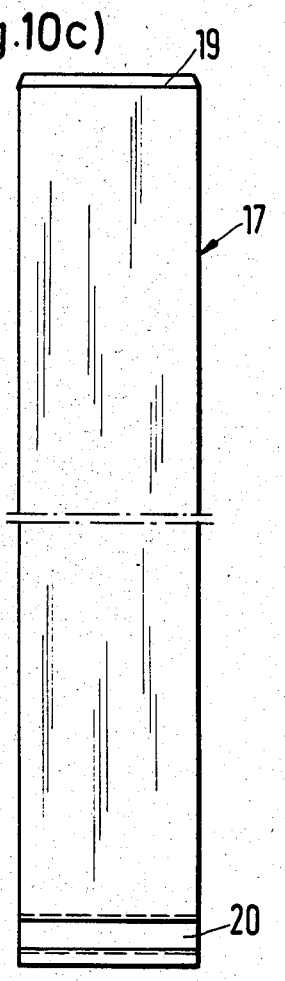
Fig.10e)
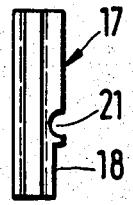
Fig.11
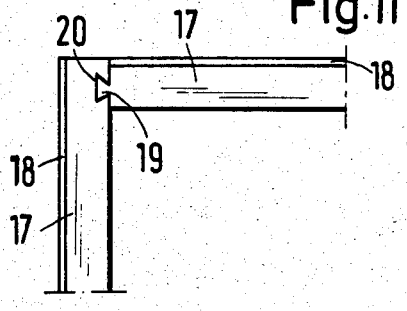

FLOOR PLATE

BACKGROUND OF THE INVENTION

1. Field of the Invention

The present invention relates generally to a floor panel for buildings or the like, and more particularly to a floor panel for use in elevated floor structures which is a rectangular floor plate comprised of a base plate and a frame made of the same material as the base plate and is pan-shaped so as to accommodate a fill, with the circumferential edge of the frame being angled toward the exterior.

2. Discussion of the Art

Floor plates are used as the basis for floor panels which are assembled into a composite floor slab for a double floor. The corners of such floor panels are placed onto supports or pedestals which themselves are placed onto a raw floor. The floor plate is manufactured of a material having high tensile strength and a high modulus of elasticity, for example, steel sheet. The base plate and the frame form a pan into which a flowable or pourable and hardenable material having low tensile strength and a low modulus of elasticity, for example, concrete, may be introduced to form a floor panel. The upper face of the material or the composite slab may be covered with a covering material.

A floor plate of the type mentioned above is disclosed in German Gebrauchsmuster (Utility Patent) 78/04,148. In this known floor plate, the frame extends conically outwardly beginning at the base plate. Its circumferential edge changes to an outwardly projecting circumferential flange which ends in an abutment edge. Adjacent floor plates contact one another along these abutment edges. A covering layer is applied so as to be offset backwardly from the abutment edges. After the floor plates are filled and covered, grooves appear between the covering layers of adjacent floor panels of a composite slab and are filled with a permanently elastic putty so as to produce a water and air tight seal. This known floor panel has no features which increase its bending strength and which produce a fire-inhibiting effect in the crevices or edge regions in which adjacent floor panels abut one another. Moreover, when the floor panels of composite slabs are removed and reinstalled, the putty must be renewed.

In the floor panel disclosed in German Offenlegungsschrift (Published Non-Examined Application) 2,700,619, which corresponds to U.S. Pat. No. 4,067,156, the base plate is a body of non-flammable, concrete-like material which is given increased bending strength by having a reinforcing frame or grid imbedded therein. The body is formed with a plurality of cavities (or inwardly oriented recesses) within zones bounded by the reinforcing grid.

In the floor panel disclosed in German Gebrauchsmuster (Utility Patent) 81/07,208, an air tight seal of the crevices between adjacent floor panels of a composite slab is obtained by the provision of an elastic circumferential sealing strip at the undercut edge of the floor panel.

SUMMARY OF THE INVENTION

It is an object of the invention to combine, in a floor plate of the above-mentioned type, measures for increasing bending strength and measures for providing a frame design in which the filler material is firmly connected with the floor plate and in which a channel in the edge region may be provided with an air and water tight seal and/or fire-inhibiting materials for bridging the crevices between adjacent floor plate when assembled as a composite slab.

This object and others to become apparent as the specification progresses, are accomplished by the invention, according to which, briefly stated, the floor plate has a pan having a base plate and a frame; the base plate extends in a plane and has a plurality of ribs extending parallel to one another and projecting from the plane of the base plate. The frame extends integrally from the base plate along a perimeter thereof and in the same direction as the ribs. There are further provided a plurality of reinforcing rails extending parallel to one another and perpendicularly to the ribs; each rail is fastened to several ribs. A channel is formed along a free circumferential edge of the frame; the channel is open in a direction toward the plane of the base plate.

The advantages realized by the present invention stem from the ribs, the reinforcing rails and the frame design which make the floor plate extremely rigid. Additionally, the frame configuration permits triple use of the floor plate. Without additional elements, the floor plate can be used for applications where no additional stress is incurred. With a sealing strip inserted in the channel, the floor plate can be used in cases where an air and water tight seal of the crevices between adjacent floor panels in a composite slab is important, for example, for floors to be covered with carpeting, ceramic tiles or plastic floor covering. If carpeting is applied to the composite slab, the doubly angled, i.e., rolled, circumferential edge of the floor plate according to the invention is smooth, compared to cut-only edges according to the prior art, and inadvertent cutting of the carpeting or other floor covering is avoided. If strips of fire-inhibiting materials are inserted into the channel, the floor plate is suitable for use in cases where fire-inhibiting properties must be provided also in the edge regions or crevices of the floor panels of the composite slab, possibly in combination with an air and water tight seal. According to a further feature of the invention, the frame is provided with inwardly and downwardly oriented tabs bent out of the frame and serving for anchoring the filler material to the floor plate to thus ameliorate a firm connection between floor plate and filler material.

BRIEF DESCRIPTION OF THE DRAWINGS

FIG. 10*a* is a top plan view of the strip shown in FIG. 9.

FIG. 10*b* is a side elevational view of the strip shown in FIG. 9.

FIG. 10*c* is the other side elevational view of the strip shown in FIG. 9.

FIG. 10*d* is an end elevational view of one end of the strip shown in FIG. 9.

FIG. 10*e* is an end elevational view of the other end of the strip shown in FIG. 9.

FIG. 11 is a top plan view of a joint between two strips shown in FIGS. 10*a–e*.

DESCRIPTION OF THE PREFERRED EMBODIMENTS

Figure 2:
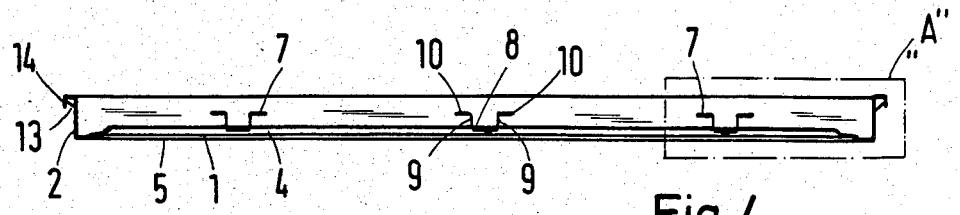
FIG. 2 is a sectional view taken along line A—A of FIG. 1.
Figure 4:
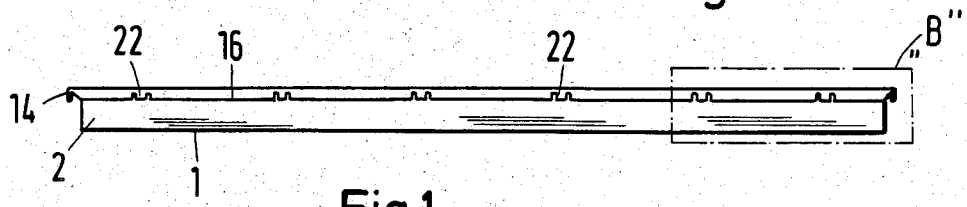
FIG. 4 is a front elevational view of the preferred embodiment as seen in the direction X of FIG. 1.
Figure 1:
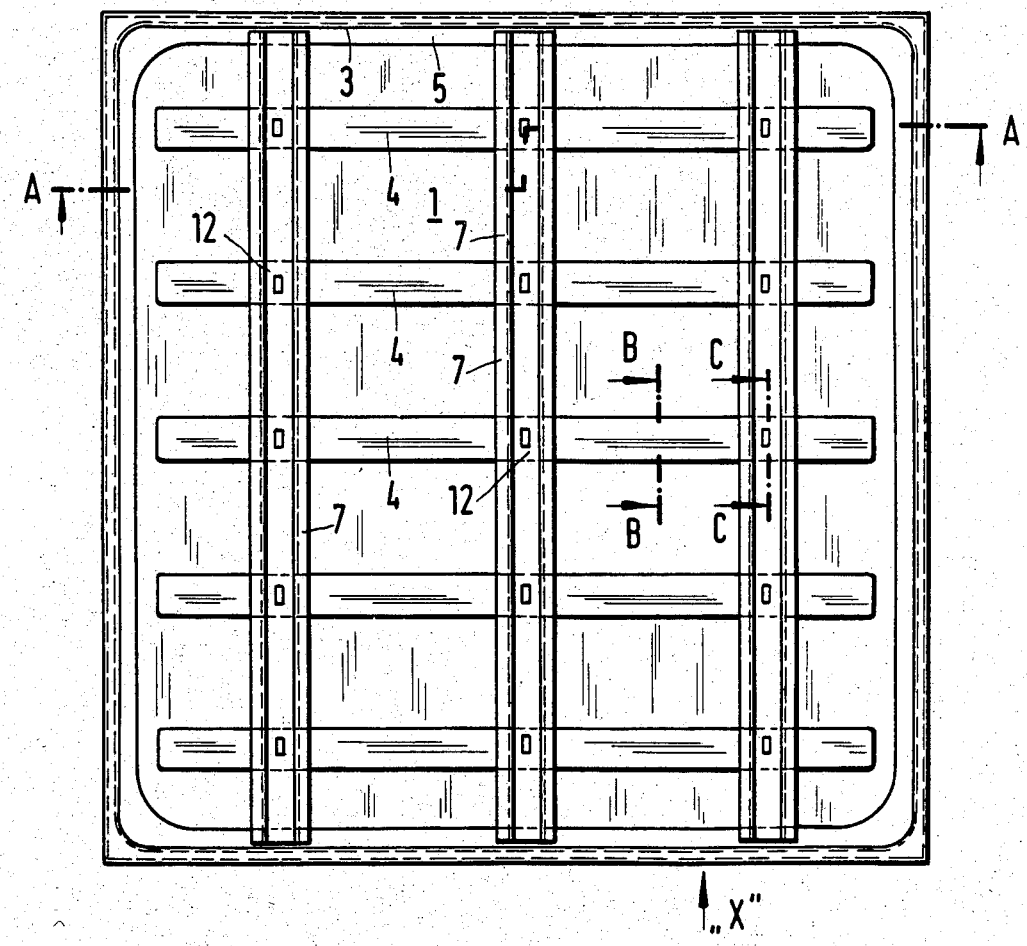
FIG. 1 is a top plan view of a floor plate according to a preferred embodiment of the invention.

Turning to FIG. 1, the floor plate selected as the preferred embodiment is four-sided and is adapted to be supported at its corners. It is composed of a base plate 1 and a frame 2 which are integral and are made of the same material, and which together form a pan accommodating a filler material. The floor plate is made of a material having a high tensile strength and a high modulus of elasticity, for example, tin-plated steel sheet. The pan serves to accommodate a fill of a flowable or pourable and hardenable material (not shown) having low tensile strength and a low modulus of elasticity, for example, concrete. A floor covering (not shown) may be positioned on the upper surface of the filler.

A plurality of elongated ribs 4 are formed in base plate 1, such as by pressing, and extend inwardly from the plane occupied by the base plate 1 parallel to one another. The ribs 4 extend in a direction parallel to two opposing sides of a side edge 3. At the transition to frame 2—in the region of side edges 3—a gutter-like circumferential edge region 5 is provided in base plate 1 by pressing outwardly. At a distance from edge region 5, ribs 4 are pressed inwardly, all in the same direction. The gutter-like grooves of edge region 5 are thus open toward the interior of the floor plate; the grooved contours of ribs 4 are open toward the exterior.

Figure 9:
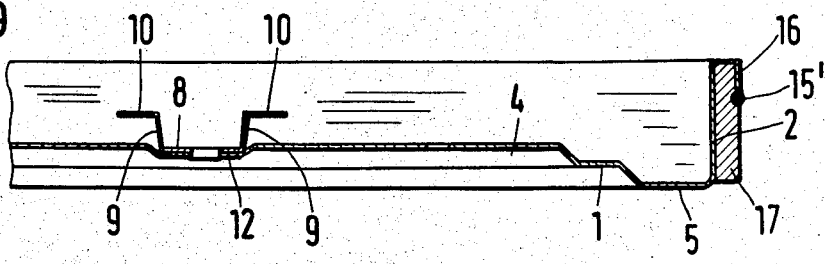
FIG. 9 is similar to FIG. 3, including a sealing strip.
Figure 13:
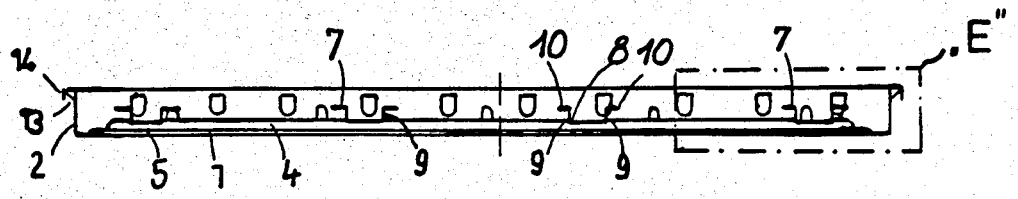
FIG. 13 is a sectional view taken along line D—D of FIG. 12.

Perpendicularly to ribs 4, a reinforcement is provided in base plate 1 in the form of a plurality of reinforcing rails 7 which are positioned in a mutually spaced relationship. As shown in FIG. 1, the rails 7 extend parallel to one another and perpendicularly to ribs 4 to which the rails 7 are fastened. The rails 7 are preferably of a double-Z cross-sectional shape. With reference to FIG. 9, each double-Z rail 7 is composed of a bottom portion 8, two perpendicular center pieces 9 extending from the longitudinal edges of bottom portion 8 and flanges 10 which extend from the free edges of center pieces 9 toward the exterior.

Figure 3:
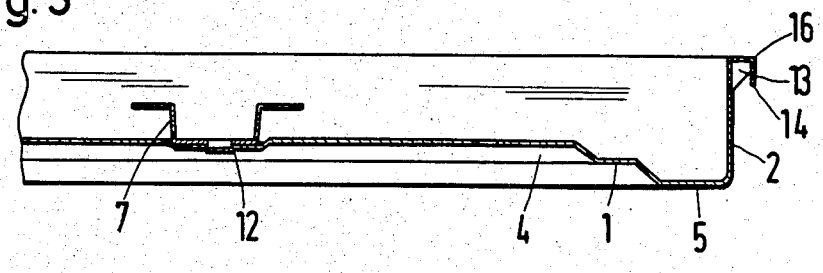
FIG. 3 is an enlarged sectional elevational view of detail A of FIG. 2.
Figure 5:
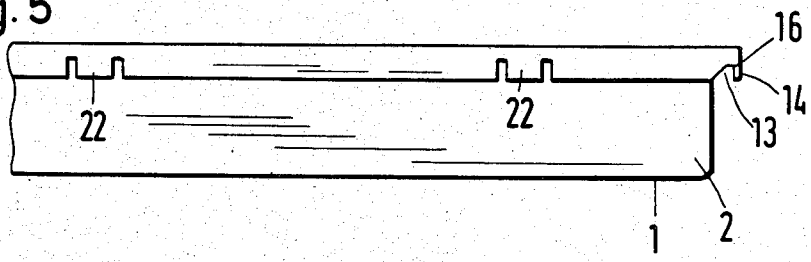
FIG. 5 is an enlarged view of detail B of FIG. 4.
Figure 6:
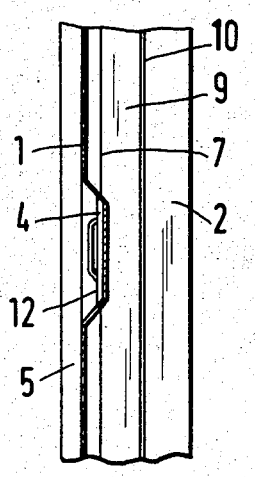
FIG. 6 is an enlarged fragmentary sectional view taken along line B—B of FIG. 1.
Figure 7:
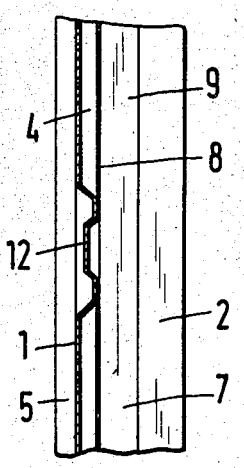
FIG. 7 is an enlarged fragmentary sectional view taken along line C—C of FIG. 1.
Figure 14:
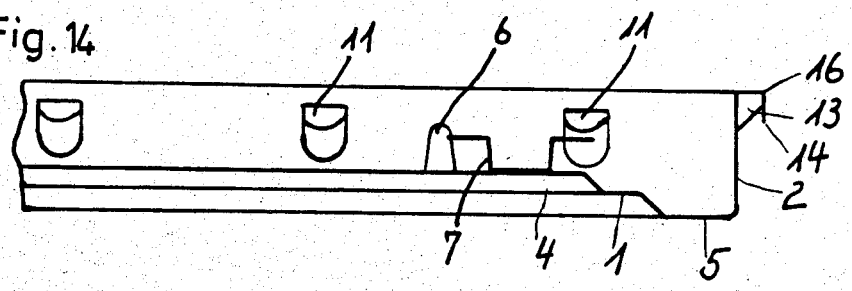
FIG. 14 is an enlarged sectional elevational view of detail E of FIG. 13.

Each rail 7 bridges a plurality of ribs 4 and the bottom portion 8 of each double-Z rail 7 is welded to the bridged ribs 4 of base plate 1. For this purpose, ribs 4 are flattened in region 12, as shown, for example, in FIG. 9, where they are bridged and contacted by the double-Z rails 7. Welding of double-Z rails 7 to ribs 4 may be effected by clinching. In this clinching process, not only is the bottom portion 8 of double-Z rail 7 pushed into region 12 of ribs 4, but material is also pushed further outwardly at certain points, as shown in FIGS. 3 and 14, i.e., the portion of the rib 4 beneath the region 12.

Along its circumferential edge, frame 2 is angled twice to form a channel 13. The edge is first angled outwardly toward the exterior and then an extremity thereof is angled in the direction toward the plane occupied by base plate 1. This produces the channel 13 that is open toward the floor, i.e., in the direction toward the plane of the base plate.

Figure 8:
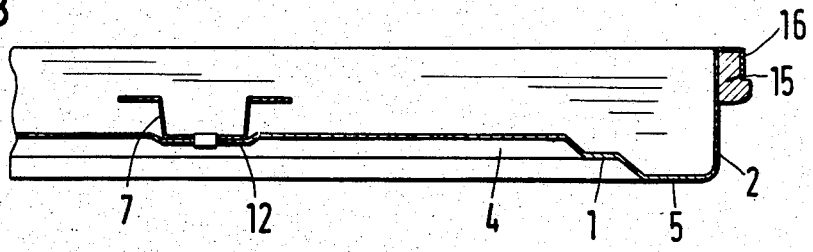
FIG. 8 is similar to FIG. 3, including a sealing strip.

In the embodiment shown in FIG. 8, the channel 13 is provided with a circumferential sealing strip 15, which is preferably made of foam rubber. At least a portion of the sealing strip 15 projects through the open portion of the channel 13 and outwardly beyond the frame 2 as shown. In each floor plate which is part of the same composite double floor, sealing strips 15 are arranged to extend at the same distance from frame 2. Sealing strips 15 of adjacent floor plates are thus pressed against one another. The crevice or groove between adjacent floor plates is thus sealed in an air and water tight manner.

In the embodiment shown in FIGS. 9 through 11, the channel 13 is provided circumferentially with a plurality of strips 17 made of a fire-inhibiting material. At least a portion of the strips 17 project through the open portion of the channel 13, as shown in FIG. 9. Four strips 17 are inserted into the open channel 13 along each of the four sides of the frame 2, respectively. Each strip 17 has a length which is essentially equal to the length of the respective side of the frame 2 less the thickness of one adjacent strip with which each strip 17 abuts, a width which is equal to the height of the frame 2, and a thickness which is equal to the width of channel 13. In order for strip 17 to be able to extend or project through the open portion of channel 13 past side face 14, strip 17 is provided with a recess 18 in the region accommodated by channel 13. That is, the portion of the strips 17 which project through the open portion of the channel 13 have a greater thickness than the portion thereof accommodated in the channel 13. Length and depth of recess 18 are equal to the length and depth of an outer arm 16 of the circumferential edge of the frame member 2 forming side face 14.

The strips 17 may dove-tailingly engage one another, as shown in FIG. 11. Each strip 17 has a first end which abuts an adjacent strip and a second end which abuts the channel 13. Each first end or first frontal face is provided with a rib 19 which is arranged parallel to its longitudinal sides and which protrudes from the end surface thereof which abuts the adjacent strip. At a distance from the opposite frontal face, at the inner longitudinal side, i.e., proximate the second end, each strip is provided with a groove 20 arranged to matingly engage or accommodate rib 19 of adjacent strip 17. Strips 17 accommodated by channel 13 are thus snapped into one another by means of ribs 19 and grooves 20 which have a dove-tailed cross-sectional configuration. They assure precise and secure assembly of strips 17 including parallelism with respect to the adjacent edges and faces. Strips 17 of adjacent floor panels rest against one another along portions thereof which project or extend downwardly of side faces 14. Thus a fire-inhibiting configuration is also realized in the circumferential edge regions of the floor panel.

If in addition to the fire-inhibiting design, an air and water tight design is selected, a longitudinal groove 21 may be provided in the outer face, i.e., along the outermost surface of strip 17, and a circumferential sealing strip 15' of circular cross section (shown in FIG. 9), is accommodated in the longitudinal groove 21.

To securely mount either sealing strip 15 and/or strips 17 of FIGS. 8 and 9, a plurality of tongues 22 may be provided in the portion of the circumferential edge of the frame member 2 which is angled downwardly to form the channel 13, i.e., in the outer arms 16 of frame 2. Spaced pairs of cuts may be made therein and the tongues 22 so formed may further be angled inwardly into the channel 13. These resilient tongues 22 thus serve to securely hold sealing strips 15 or 17. To provide better seating, pockets (not shown) may be provided in strips 17 at the level of tongues 22.

Turning now to FIGS. 12, 13, 14, 15 and 16, there is illustrated therein another preferred embodiment of the invention. This embodiment differs from that described in connection with FIGS. 1–11 in that it includes a plurality of spaced embossments 6 and a plurality of tabs 11 and further, it has four rails 7 instead of three shown in the first embodiment.

Figure 15:
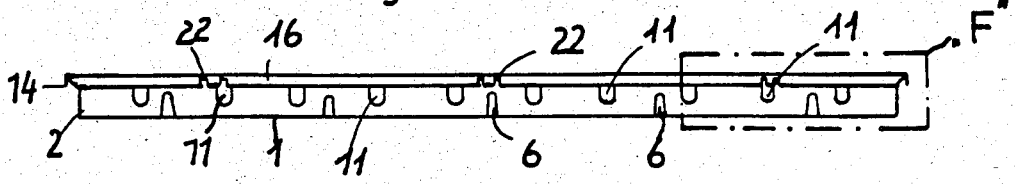
FIG. 15 is a front elevational view of the structure shown in FIG. 12, as seen in the direction of arrow Y of FIG. 12.
Figure 12:
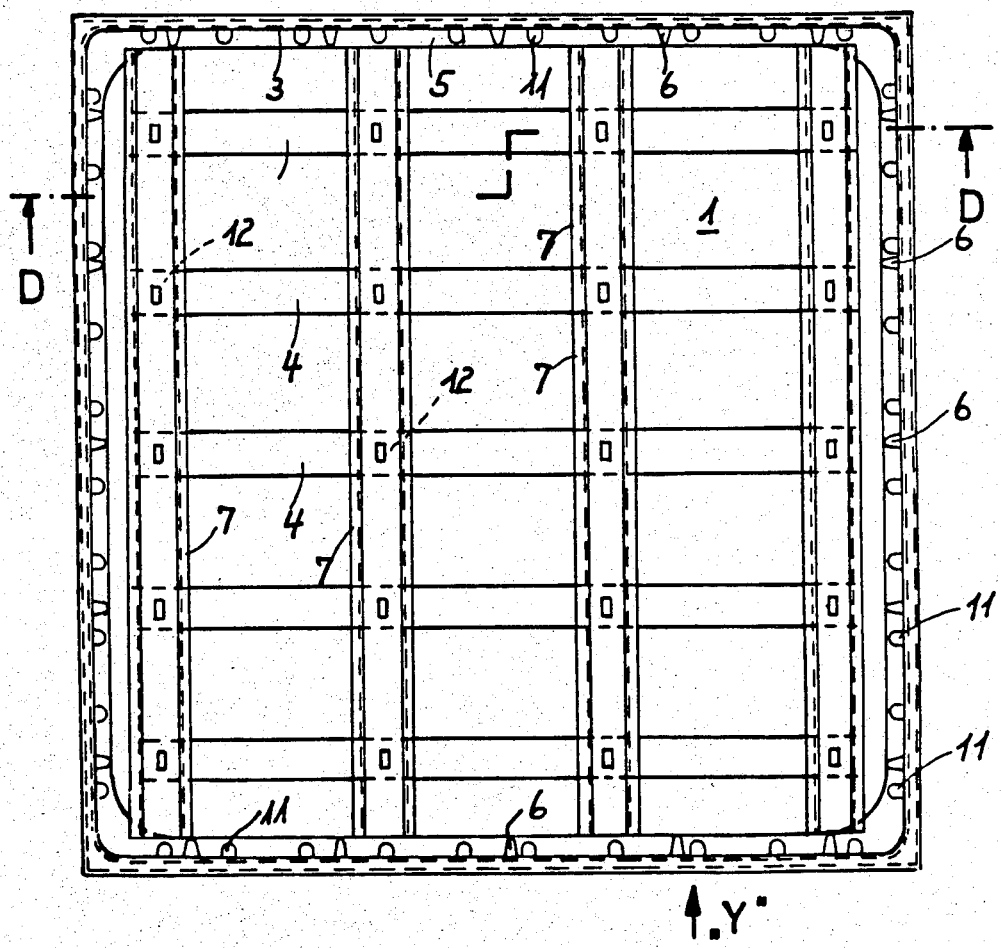
FIG. 12 is a top plan view of a floor plate according to another preferred embodiment of the invention.

As it may be best observed by viewing FIGS. 12 and 15 together, the embossments 6 extend peripherally about the base plate 1 in a spaced relationship to one another. Each embossment 6 has a part which is provided in the edge region 5 of the base plate 1 (FIG. 12) and a part which is provided in the frame 2 (FIG. 15). Thus, each embossment 6 has essentially an L-shaped configuration. The embossments 6 further enhance the strength of the floor plate.

Figure 16:
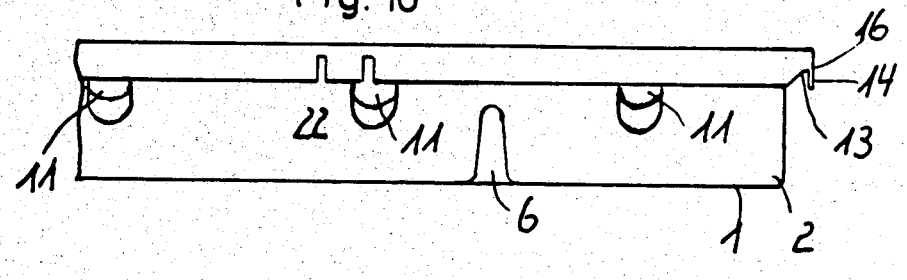
FIG. 16 is an enlarged sectional elevational view of detail F of FIG. 15.

Particularly referring to FIGS. 12, 14 and 16, the tabs 11 are bent out from the frame 2 and are oriented obliquely inwardly, that is, in the direction of the base plate 1. The tabs 11 serve as anchors to enhance a firm connection of the subsequently applied filler material and the frame 2 of the floor plate.

It will be understood that the above description of the present invention is susceptible to various modifications, changes and adaptations, and the same are intended to be comprehended within the meaning and range of equivalents of the appended claims.

What is claimed is:

1. A floor plate adapted to accommodate a filler material, comprising:

a pan having a base plate and a frame, said base plate extending in a plane and having a plurality of ribs extending parallel to one another and projecting from said plane; said frame extending integrally from the base plate along a perimeter thereof and in the same direction as the ribs;

a plurality of reinforcing rails extending parallel to one another and perpendicularly to the ribs; each said rail being fastened to a plurality of said ribs; and a channel formed along a free circumferential edge of the frame; the channel being open in a direction toward said plane.

2. A floor plate according to claim 1, wherein the ribs are provided by pressing the base plate inwardly, and wherein a gutter-like circumferential edge region is provided in the base plate at a zone of transition between the base plate and the frame by pressing the base plate outwardly.

3. A floor plate as defined in claim 2, further comprising a plurality of spaced embossments, each provided partially in said frame and partially in said edge region, whereby each said embossment has an L-shaped configuration.

4. A floor plate according to claim 1, further comprising a circumferential sealing strip provided in the channel, at least a portion of the sealing strip projecting beyond the channel in the direction toward the plane of the base plate and outwardly beyond the frame.

5. A floor plate according to claim 4, wherein the circumferential sealing strip is comprised of foam rubber.

6. A floor plate according to claim 1, further comprising a plurality of strips provided in the channel and comprised of a fire-inhibiting material, at least a portion of the strips projecting beyond the channel in a direction toward the plane of the base plate.

7. A floor plate according to claim 6, wherein the portion of the strips which projects beyond the channel has a greater thickness than the portion thereof accommodated in the channel and has a longitudinal groove provided therein along its outermost surface, the floor plate further comprising a circumferential sealing ring accommodated in the longitudinal groove.

8. A floor plate according to claim 1, wherein said channel is formed by a first, outwardly angled, angled portion of said free circumferential edge of said frame and a second angled portion of said free circumferential edge; said second angled portion being oriented toward the plane of the base plate.

9. A floor plate according to claim 8, wherein the second angled portion is provided with a plurality of tongues angled inwardly into the channel whereby the circumferential sealing strip is secured in the channel.

10. A floor plate according to claim 1, wherein the plurality of rails each have a double-Z cross section which has a bottom portion extending in parallel to the base plate, and wherein each rail bridges a plurality of ribs and is welded thereto along the bottom portion thereof.

11. A floor plate according to claim 10, wherein the ribs are flattened in the region where they are bridged by the rails, and wherein welding is affected by clinching.

12. A floor plate according to claim 1, wherein the base plate and the frame are comprised of a metal or metal alloy having a high tensile strength and a high modulus of elasticity.

13. A floor plate according to claim 11, wherein the metal or metal alloy is a steel.

14. A floor plate according to claim 1, wherein the floor plate is rectangular and wherein said ribs extend parallel to two opposing sides of the floor plate.

15. A floor plate according to claim 14, further comprising four strips provided in series in the channel, one strip for each of the four sides of the frame; said strips being comprised of a fire inhibiting material; at least a portion of the strips projecting beyond the channel in a direction toward said plane; each strip abuttingly overlapping one other strip and having a thickness equal to the width of the channel, a width equal to the height of the frame, and a length equal to the length of the respective side of the frame less the thickness of one adjacent strip.

16. A floor plate as defined in claim 15, wherein the strips dove-tailingly engage one another, each strip having a first end which abuts an adjacent strip and second end which abuts the channel, each first end being provided with a rib protruding from the end surface thereof which abuts the adjacent strip, each strip being provided with a groove proximate the second end and matingly engaging one rib from the adjacent strip.

17. A floor plate as defined in claim 1, further comprising a plurality of tabs bent out from said frame; each said tab being oriented toward and obliquely with respect to, said base plate.

* * * * *